US006929256B2

(12) United States Patent
Kawatsu et al.

(10) Patent No.: US 6,929,256 B2
(45) Date of Patent: Aug. 16, 2005

(54) POST PROCESSING DEVICE WITH SADDLE STITCHING

(75) Inventors: Kenji Kawatsu, Hachioji (JP); Hiroyuki Wakabayashi, Hachioji (JP); Kohji Yoshie, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/652,459

(22) Filed: Aug. 29, 2003

(65) Prior Publication Data

US 2004/0071529 A1 Apr. 15, 2004

(30) Foreign Application Priority Data

| | | |
|---|---|---|
| Sep. 3, 2002 | (JP) | 2002-257503 |
| Sep. 17, 2002 | (JP) | 2002-269810 |
| Sep. 17, 2002 | (JP) | 2002-269811 |
| Sep. 25, 2002 | (JP) | 2002-278603 |
| Sep. 27, 2002 | (JP) | 2002-283064 |

(51) Int. Cl.[7] ..... B65H 37/04

(52) U.S. Cl. ..... 270/37; 270/32; 270/58.08; 270/52.26; 83/934; 493/445

(58) Field of Search ..... 270/32, 37, 58.07, 270/58.08, 52.26; 412/16, 18; 83/934; 493/378, 383, 384, 445

(56) References Cited

U.S. PATENT DOCUMENTS

| | | | | |
|---|---|---|---|---|
| 4,030,394 A | * | 6/1977 | Kistner et al. | 83/409 |
| 4,592,651 A | * | 6/1986 | Oikawa et al. | 355/72 |
| 4,595,187 A | * | 6/1986 | Bober | 270/37 |
| 5,377,965 A | * | 1/1995 | Mandel et al. | 270/37 |
| 6,364,553 B1 | * | 4/2002 | McCue et al. | 400/625 |
| 2001/0054342 A1 | * | 12/2001 | Kato et al. | 83/78 |

FOREIGN PATENT DOCUMENTS

| | | | | |
|---|---|---|---|---|
| JP | 60-254165 | | 12/1985 | |
| JP | 7-179262 | | 7/1995 | |
| JP | 11-237358 | | 8/1999 | |
| JP | 2000-72320 | | 3/2000 | |
| JP | 2001-267810 | | 9/2001 | |
| WO | WO 00/18583 | * | 6/2000 | B42D/1/06 |

* cited by examiner

*Primary Examiner*—Patrick Mackey
(74) *Attorney, Agent, or Firm*—Squire, Sanders & Dempsey L.L.P.

(57) ABSTRACT

An image forming apparatus integrally having a sheet post-processing apparatus is disclosed. The apparatus includes a center folding unit for creasing, a stack unit which has an angular shape, and a pushing unit which pushes up the paper sheets stacked on said stack means. The apparatus also includes a first convey unit for conveying a creased paper sheet or the like and stacking paper sheets or the like on the stack unit. The apparatus further includes a convey assistance unit provided near a top portion the stack unit and a saddle stitching unit for forming a predetermined number of paper sheets or the like stacked into a booklet. In addition, the apparatus also includes a second convey unit for conveying the saddle-stitched booklet in a two-folded state, a cutting unit for performing a cutting process, and a discharging unit for discharging the two-folded booklet outside the apparatus.

9 Claims, 9 Drawing Sheets

POST PROCESSING DEVICE WITH SADDLE STITCHING

BACKGROUND OF THE INVENTION

1. Field of the Invention

The present invention relates to an image forming apparatus such as an electrophotographic copying machine, printer, or facsimile apparatus integrating a post-processing apparatus for paper sheets on which images have been formed.

2. Description of the Prior Art

A processing apparatus is known, which is designed to saddle-stitch image-bearing paper sheets stacked on a proper member by driving metal staples using a stapler constituted by a staple driving means (stitcher) and staple receiving means (clincher) and then discharge the sheet bundle in the form of a two-folded booklet outside the apparatus.

For example, the following arrangement is known as part of a bookbinding apparatus (see, for example, paragraph numbers 0005, 0007, and 0025 and FIGS. 8, 9, and 13 in Japanese Unexamined Patent Publication No. 11-237358 as patent reference 1). A plurality of feeders are provided along the longitudinal direction of a convey means called a gathering chain. Creased paper sheets are stacked on the respective feeders in advance. The paper sheets are then made to fall from the feeders one by one in synchronism with the rotation of the gathering chain so as to be stacked on the chain. Thereafter, a stapler is actuated to wire-stitch the paper sheets.

In another post-processing apparatus, after paper sheets on which images are formed by a printer or the like are stacked on each other at a predetermined position and saddle-stitched by a stapler, the sheet bundle is folded in two in another place and discharged in the form of a booklet (see, for example, paragraph numbers 0027 and 0028 and FIG. 1 in Japanese Unexamined Patent Publication No. 2000-72320 as patent reference 2).

There is known a copying machine, which has a bookbinding function of center-folding paper sheets having undergone copying operation one by one at a middle portion, stacking the paper sheets on an angular support member, and binding the crease portions by using a binding unit (see, for example, the upper right column and FIGS. 2, 3, and 6 in Japanese Unexamined Patent Publication No. 60-254165 as patent reference 3).

In addition, the following automatic online section finishing apparatus is known (see, for example, paragraph numbers 0020 to 0031 and FIGS. 4 to 13 in Japanese Unexamined Patent Publication No. 7-179262 as patent reference 4). In the apparatus, image-bearing paper sheets are creased one by one on a convey path and made to fall on an angular stack means so as to be stacked thereon. The stacked paper sheets are slid on the stack means to be placed at a stapler position to be saddle-stitched. The saddle-stitched sheet bundle is returned to the initial position (middle portion). The sheet bundle is pushed upward by a blade member through the crease of the paper sheet at the lowest position and conveyed to the next process by a pair of rollers functioning as a center-folding means.

According to arrangement disclosed in patent reference 1, however, the necessity of installing a plurality of feeders along the longitudinal direction of the gathering chain will increase the size of the apparatus. In addition, since the sections of paper sheets are made to synchronously fall, it is difficult to perform alignment control. Furthermore, each feeder has a complicated structure.

In addition, since stapling processing (binding process) is performed while the sections of paper sheets are placed on the chain, it is difficult to drive staples at positions on the crease line. As a consequence, the resultant sheet bundle does not look good as a booklet.

The arrangement disclosed in patent reference 2 is designed to perform a center folding process as saddle stitching. Assume that the number of paper sheets is as large as 15 or 20. In this case, although paper sheets located inward can be creased, it becomes more difficult to crease paper sheets located outward due to the lack of power of a center-folding means. When the paper sheets are folded in two to form it into a booklet, therefore, outer paper sheets curl, making it difficult to obtain a booklet in a high quality state.

In other words, even if this apparatus has the ability of the saddle stitching means (to be also referred to as a stapler hereinafter) for binding 20 paper sheets, it is impossible to make the full use of the ability.

In order to make the full use of the ability of the stapler, the size of the arrangement must be increased to increase the power of the center folding means.

In addition, since the saddle stitching unit and center folding unit are arranged at different positions, the production efficiency is not so high.

According to the arrangement disclosed in patent reference 3, creased paper sheets are sequentially stacked on the flat guide plates provided on the two sides of the support member and aligned (position-regulated) by alignment rollers. Thereafter, the two guide plates are pivoted to form an angular shape so as to align the crease of each paper sheet with the top portion of the support member. However, since the mechanism for aligning paper sheets with each other is complicated and has many movable members, it takes much time to support a loose sheet bundle on the support member.

The arrangement disclosed in patent reference 4 needs to apply a load on the paper sheets stacked on the stack means because they are moved when saddle-stitched or to have a special member for discharging the saddle-stitched sheet bundle from the stack means, resulting in inefficient use of space.

Furthermore, the top portion of the stack means is located immediately below the folding rollers, and paper sheets are clamped between the folding rollers by using the buckling of the paper sheets to crease them. This arrangement makes the space near the stack portion crowded. In addition, for the sake of sheet alignment, rotatable paddle wheels must be provided on the two outer sides of the angular stack means.

SUMMARY OF THE INVENTION

The present invention has been made to solve the above problems in the prior arts, and has as its object to provide an image forming apparatus which can easily align a predetermined number of creased paper sheets on a stack means having an angular shape and can continuously and efficiently perform a series of operation of forming images, forming the paper sheets into a booklet, and discharging it by performing saddle stitching at the place where the paper sheets are aligned.

In order to achieve the above object, according to the main aspect of the present invention, there is provided an image forming apparatus integrally having a sheet post-processing apparatus comprising center folding means for creasing, on a convey path for conveying image-bearing paper sheets and/or cover sheets one by one in a predetermined direction, the paper sheet and/or cover sheet in a direction perpendicular to the convey direction of the paper sheets, stack means which has an angular shape and on which a paper sheet and/or cover sheet is stacked, first convey means for conveying a paper sheet and/or cover sheet, in an open state, on which a crease is produced by the center folding means, and stacking a predetermined number of paper sheets and/or cover sheets on the stack means for every operation, convey assistance means provided near a top portion the stack means, saddle stitching means for forming a predetermined number of paper sheets and/or cover sheets stacked on the stack means into a booklet (sheet bundle) by binding the paper sheets and/or cover sheets at the crease, second convey means for conveying the saddle-stitched booklet in a two-folded state, cutting means for performing a cutting process so as to align edges of the two-folded booklet, and discharging means for discharging the two-folded booklet outside the apparatus after the cutting process.

The present invention has many secondary aspects associated with the image forming apparatus described in the main aspect. The following are representative ones of the secondary aspects.

(1) The apparatus further comprises a pushing member which pushes up the paper sheets stacked on the stack means through the crease of a lowermost paper sheet of the paper sheets, a press member which is placed to oppose the pushing member through a predetermined gap such that a space in which a paper sheet is stacked is defined between the press member and the pushing member, and a regulating member which is movable in a width direction of a paper sheet and provided at a height position where the regulating member comes into contact with the crease of the paper sheet or a portion near the crease so as to regulate the paper sheet stacked on the stack means in the width direction, and the press member can reciprocally move in the same direction as a moving direction of the pushing member.

(2) The stack means comprises a first guide member which is located upstream in a moving direction of a paper sheet, has a predetermined length in the depth direction, and descends from an upper end portion in a first direction at a predetermined tilt angle, a second guide member which is located downstream from the first guide member in the moving direction of the paper sheet, is positioned to oppose the first guide member, has a substantially same length as that of the first guide member in the depth direction, and descends from an upper end portion spaced apart from the upper end portion of the first guide member by a predetermined distance in a second direction opposite the first direction at a substantially same tilt angle as that of the first guide member, and a stopper against which a leading end portion of a paper sheet stacked on a guide surface of the second guide member abuts, the stopper being pivotal in accordance with a size of a paper sheet and located at a position corresponding to a distance slightly longer than a length from a leading end of a paper sheet to be used to a crease in a convey direction of the paper sheet.

(3) The first convey means comprises an air suction portion which is located near an upstream side of the stack means and includes air suction means, and a rotatable convey belt placed outside the air suction portion, and a paper sheet convey surface of the convey belt is an inclined surface gradually ascending toward the stack means.

(4) One of the first and second guide members arranged as the stack means to oppose each other is made movable from a steady position to a top.

(5) The guide member which is made movable pushes and transfers a saddle-stitched sheet bundle through a crease of a lowermost paper sheet of the sheet bundle, so as to clamp a center-folded portion of the sheet bundle as a leading end between a pair of second convey means located downstream of the guide member in a paper sheet convey direction.

(6) The apparatus further comprises third convey means which is provided between the second convey means and the cutting means and is constituted by a roller and a belt roller so as to change a convey direction of the conveyed booklet.

As is obvious from the above aspects, according to the present invention, paper sheets can be easily aligned on the stack means. In addition, since conveyed paper sheets are sequentially stacked in an angular shape, efficient operation can be done. Furthermore, a series of operations from image formation to the production of a booklet can be continuously performed.

In addition, according to the present invention, alignment of the creases of paper sheets and saddle stitching as a finishing process can be properly performed with a relatively simple arrangement.

According to the present invention, since a folding process is performed while a portion near a portion to be folded is pressed, no paper sheet shifts during the process. In addition, since the chopper knife is pivoted, even if a paper sheet is pressed, there is no chance that the chopper knife damages the paper sheet. A sheet post-processing apparatus in an image forming apparatus can be provided, which includes the center folding unit with a stable folding position, in which in a center folding process, paper sheets (recording sheets) hardly loosen due to the elasticity of the sheets or hardly shift during actuation of the knife.

Furthermore, according to the present invention, there is provided a sheet post-processing apparatus in an image forming apparatus in which a saddle-stitched sheet bundle is conveyed to the upper right at the tilt angle of a second guide member, and the respective means are miniaturized and rearranged to allow a feeder, cutting means, and saddle stitching means to be arranged vertically so as to allow a reduction in the area of an installation floor and effectively use a compact space.

The above and many other objects, features and advantages of the present invention will become manifest to those skilled in the art upon making reference to the following detailed description and accompanying drawings in which preferred embodiments incorporating the principle of the invention are shown by way of illustrative examples.

DETAILED DESCRIPTION OF THE PREFERRED EMBODIMENT

An image forming apparatus according to a preferred embodiment of the present invention will be described below with reference to the accompanying drawings.

Figure 1:
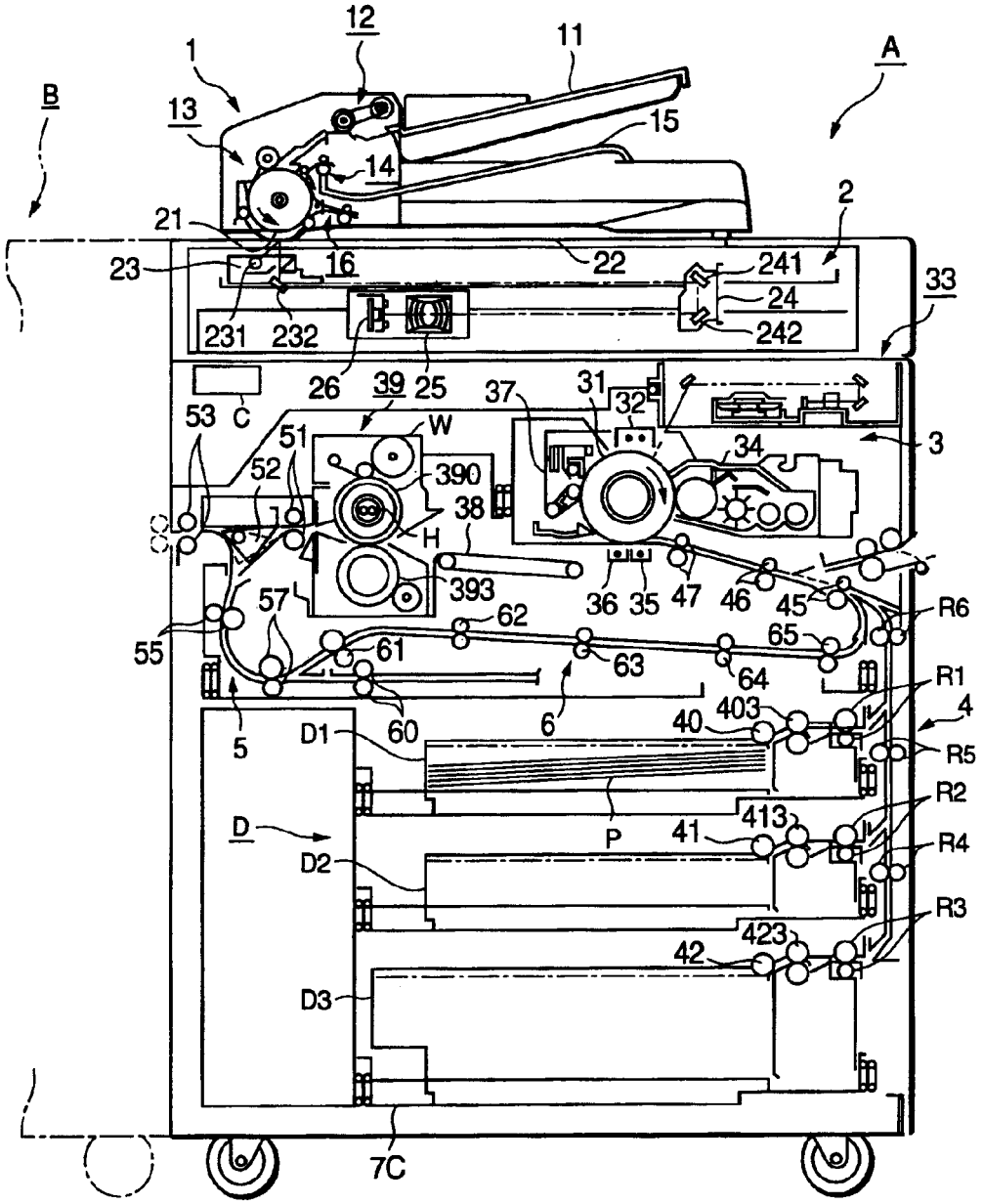
FIG. 1 is a schematic view showing the arrangement of the main body of an image forming apparatus which is formed from a digital copying machine and integrally has a sheet post-processing apparatus.

FIG. 1 is a schematic view showing the arrangement of an image forming apparatus body A formed from a digital copying machine integrating a sheet post-processing apparatus.

Referring to FIG. 1, the image forming apparatus body A includes an automatic document feeder 1, image reader 2, image processing unit C, image forming unit 3, paper storing unit D, paper feeding unit 4, paper reverse discharging/re-feeding unit 5, and reverse convey unit 6.

The automatic document feeder 1 is an apparatus for feeding documents one by one, conveying each document to the image reading position, and discharging the document having undergone image reading operation to a predetermined place.

The automatic document feeder 1 includes a document table 11 on which documents are placed, a document separating means 12 which separates a document placed on the document table 11, a document convey means 13 including a plurality of rollers for conveying the document separated by the document separating means 12, a document discharging means 14 which discharges the document conveyed by the document convey means 13, a document discharge table 15 on which the document discharged by the document discharging means 14 is placed, and a document reversing means 16 constituted by a reversing roller pair for reversing a document in the double-sided copy mode.

A plurality of documents (not shown) placed on the document table 11 are separated by the document separating means 12 one by one and conveyed through the image reading position by the document convey means 13.

The image reading position is set below the document convey means 13. At this position, the image on a document is read through a slit 21 of the image reader 2.

The document having undergone image reading operation is discharged onto the document discharge table 15 by the document discharging means 14.

The images on the upper and lower surfaces of a document are read in the following manner. When the image on one surface of the document is read, the document is guided to the document reversing means 16. While the trailing end of the document is clamped by the reversing rollers constituting the document reversing means 16, the reversing roller pair is reversed to reverse the document upside down. The document is conveyed again by the document convey means 13 to allow the image on the other surface (second surface) to be read at the document reading position.

The above process is repeated by the number of times corresponding to the number of documents placed on the document table 11.

The automatic document feeder 1 is designed to be retractable, so that a platen glass 22 can be left open by raising the automatic document feeder 1 to allow a document to be directly placed on the platen glass 22 and copied.

The image reader 2 is an apparatus for obtaining image data by reading the image on a document. The image reader 2 includes a first mirror unit 23 integrating a lamp 231 for irradiating a document with light through the slit 21 and a first mirror 232 for reflecting light reflected by the document, a second mirror unit 24 integrating a second mirror 241 for reflecting light from the first mirror 232 and a third mirror 242, an imaging lens 25 for forming reflected light from the second mirror unit 24 into an image on a CCD serving as an image sensing device, and a linear CCD 26 for photoelectrically converting the optical image formed by the imaging lens 25.

The photoelectrically converted analog signal is A/D-converted after analog processing and subjected to proper image processing such as shading correction, filter processing, and γ correction in the image processing unit C. The resultant image data is then temporarily stored in a memory.

In the mode in which the document fed by the automatic document feeder 1 is to be read by the image reader 2, the first mirror unit 23 and second mirror unit 24 are fixed at the positions shown in FIG. 1.

In the mode in which the image on the document directly placed on the platen glass 22 is to be read, reading operation is performed by moving the first mirror unit 23 and second mirror unit 24 along the platen glass 22 while keeping the optical path length unchanged.

The image forming unit 3 is a unit for forming an image by using an electrophotographic process. The image forming unit 3 includes known image forming means such as a photosensitive drum 31 having a photoconductive, photosensitive layer serving as an image carrier, a charger 32 for uniformly charging the surface of the photosensitive drum 31, a laser writing system 33 serving as an exposure means which is actuated on the basis of image data after image processing to form an electrostatic latent image by performing exposure on the photosensitive drum 31, a developing unit 34 for developing the electrostatic latent image formed on the photosensitive drum 31 into a toner image by reversal development, a transfer pole 35 for transferring the visualized toner image onto a paper sheet, a discharger 36 for promoting separation of the paper sheet from the photosensitive drum 31 by performing AC corona discharge from the lower surface of the paper sheet on which the toner image is transferred, and a cleaning means 37 for cleaning the photosensitive drum 31 after the transfer process.

Reference numeral 38 denotes a convey belt for conveying the separated paper sheet to a fixing device 39 of a heating roller type.

The fixing device 39 incorporates a heat source H and includes a fixing means as a main component constituted by an upper fixing roller 390 which independently rotates around the heat source H, and a lower fixing roller 393 which rotates in tight contact with the upper fixing roller 390.

Fixing/discharging rollers 51, switching means 52, and paper discharge rollers 53 which are constituent elements of the paper reverse discharging/re-feeding unit 5 are provided downstream of the fixing device 39.

Note that reference symbol W in the fixing device 39 denotes a cleaning web provided in contact with the surface of the upper fixing roller 390. For example, the cleaning web W is gradually taken up on a roll core shown on the left side in FIG. 1 at proper time intervals during the operation of the apparatus.

An image is formed on a paper sheet by using the above arrangement in the following manner. After the photosensitive drum 31 that is rotated by a proper driving means in the direction indicated by the arrow is sequentially charged by the charger 32, the laser writing system 33 performs dot exposure to form an electrostatic latent image corresponding to the document image. The developing unit 34 develops the electrostatic latent image into a toner image. The toner image is then transferred onto a paper sheet P, which is fed by rotating registration rollers 46 serving as the second paper feed means, owing to the effect of the transfer pole 35.

In practice, image formation, i.e., a process for forming a toner image on the photosensitive drum 31, is started in accordance with the timing of paper feeding operation upon rotation of the registration rollers 46 while the paper sheet P has reached the registration rollers 46.

In order to superimpose the toner image on the paper sheet in the transfer region where the transfer pole 35 is located, the distance from the exposure unit to the transfer pole is set to be equal to the distance from the registration rollers to the transfer pole, and the linear velocities of the photosensitive drum 31, the registration rollers 46, and pre-transfer rollers 47 are set to be equal to each other.

The paper sheet after the transfer process is separated from the photosensitive drum 31 owing to the effect of the discharger 36 and heated and pressurized by the fixing device 39. The resultant paper sheet is discharged toward the post-processing apparatus.

The photosensitive drum 31 which has passed through the transfer region continues rotating to make the cleaning means 37 remove the residual toner therefrom, thereby making preparation for the next image formation.

Returning to the description of the arrangement, in the paper storing unit D, paper feed trays D1, D2, and D3 in which paper sheets P are stored in a stacked state are vertically arranged (only the paper sheets P in the paper feed tray D1 are shown in FIG. 1).

The respective paper feed trays are so provided as to be pulled out together with paper feed rollers 40, 41, and 42 which are components of the paper feeding unit 4 and separation roller pairs 403, 413, and 423 serving as separation means for preventing multiple paper feeding.

In addition to the paper feed rollers, the paper feeding unit 4 includes convey roller pairs (to be also referred to as convey rollers hereinafter) R1, R2, R3, R4, R5, and R6 serving as convey means for conveying the paper sheets P from the paper feed trays D1, D2, and D3 to the image forming unit 3, the registration rollers 46, the pre-transfer rollers 47, and the like.

Reference numeral 45 denotes convey rollers provided downstream of the convey rollers R6 relative to the convey direction of the paper sheet P. The convey rollers 45 are provided at the confluence of the convey path along which a paper sheet is fed through the reverse convey unit 6 (to be described later) and, for example, the convey path of the paper sheet fed from the paper feed tray D1.

The paper reverse discharging/re-feeding unit 5 is a region for reversing/discharging the paper sheet P after transfer and fixing processes or re-feeding the paper sheet P in accordance with the double-sided image formation mode. The paper reverse discharging/re-feeding unit 5 has the switching means 52 for switching convey paths between a case wherein the paper sheet P discharged by the fixing/discharging rollers 51 is to be directly discharged outside the apparatus and a case wherein the paper sheet P is to be discharged after reversed upside down.

When a paper sheet P on which an image is formed is to be discharged directly, i.e., with the image-bearing surface facing up, the switching means 52 is held at the position indicated by the chain line in FIG. 1. The image-bearing paper sheet P is discharged after reversed upside down in the following manner. The switching means 52 is held at the position indicated by the solid line in FIG. 1. The paper sheet P conveyed by the fixing/discharging rollers 51 is fed into the convey path having convey rollers 55 and 57. These rollers are stopped at the timing when the trailing end of the paper sheet P reaches the front position of the convey rollers 55. Thereafter, the convey rollers 55 are rotated in the direction reverse to that in the above case to let the paper sheet P pass through the left side of the switching means 52. The paper sheet P is then discharged outside the apparatus through the paper discharge rollers 53.

Consider the double-sided image formation mode in which an image is continuously formed on the second surface of the paper sheet P after formation of an image on the first surface. In this case, the switching means 52 is held at the position indicated by the solid line in FIG. 1, and the paper sheet conveyed by the fixing/discharging rollers 51 is fed into the reverse convey unit 6 through the convey rollers 55 and 57 of the paper reverse discharging/re-feeding unit 5 which are driven by a paper discharge motor. In the reverse convey unit 6, the paper sheet P is reversed upside down and is then fed toward the registration rollers 46.

An image is transferred onto the second surface of the paper sheet P in the same process as described above, and the paper sheet P after a fixing process is discharged in one of the forms described above.

Note that the reverse convey unit 6 further includes a convey roller pair 60 which is driven/controlled to further feed the paper sheet P, conveyed by the power feed terminal 57, to the right and rotate reversely after stopping at the timing of clamping the trailing end of the paper sheet P. As the convey roller pair 60 rotates reversely, the paper sheet P is conveyed to the left halfway, and then conveyed along a convey path extending upward in an arc first and then extending to the right.

In addition to the convey roller pair 60, convey roller pairs 61, 62, 63, 64, and 65 are arranged on the convey path of the reverse convey unit 6.

Figure 2:
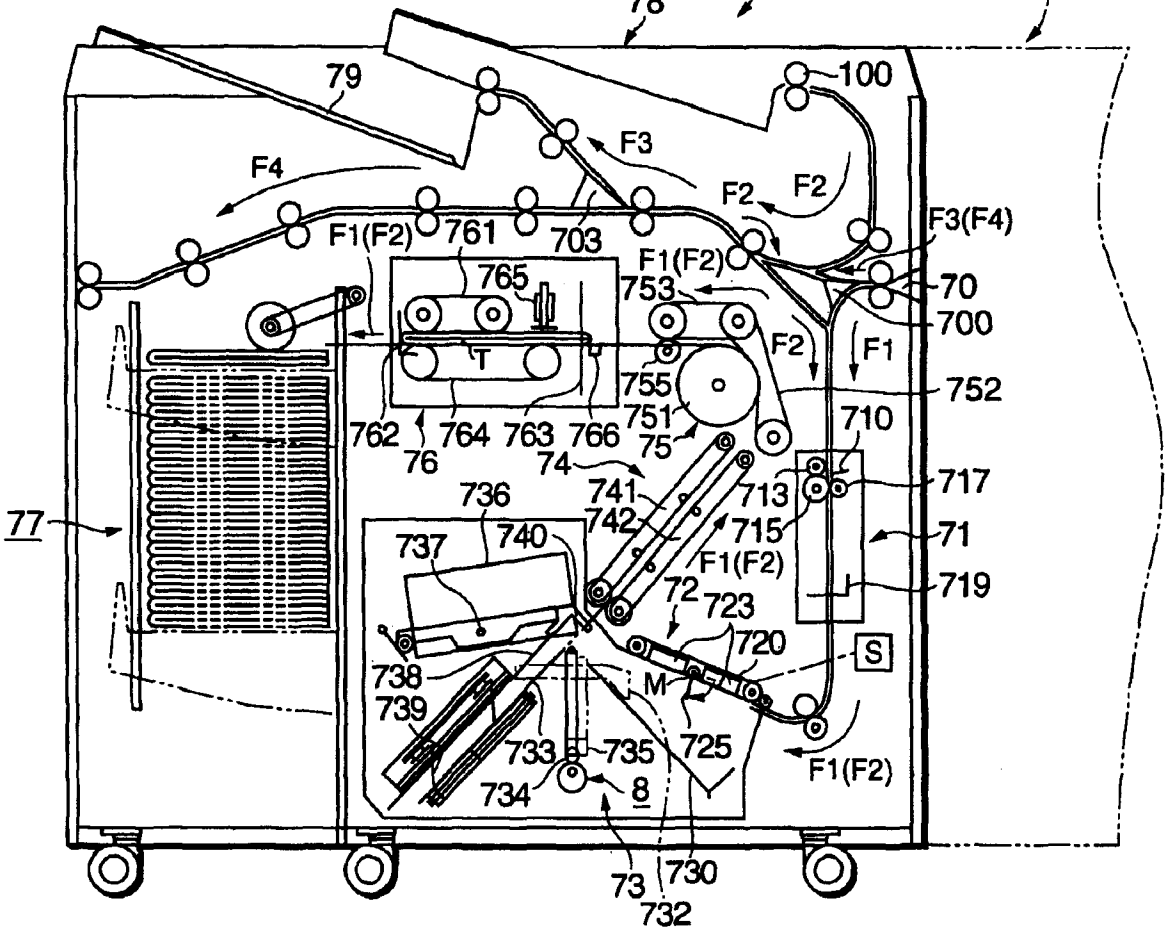
FIG. 2 is a schematic view showing the arrangement of a sheet post-processing apparatus integrally connected to the image forming apparatus body shown in FIG. 1.

FIG. 2 is a schematic view showing the arrangement of a sheet post-processing apparatus B which is integrated with the automatic document feeder 1 shown in FIG. 1.

The sheet post-processing apparatus B according to the present invention includes an inlet 70 for taking in the image-bearing paper sheet P discharged from the image forming apparatus body A by the paper discharge rollers 53 in FIG. 1, a center folding unit 71 placed on a paper sheet convey path, a first convey means 72 of an air suction scheme, a saddle stitching unit 73, a second convey means 74 formed from one pair of belts, a third convey means 75 formed from a roller and belt, a cutting unit (trimmer unit) 76, a stack unit 77, a cover sheet feeder 78, and a tray 79.

The detailed arrangement of the sheet post-processing apparatus B according to the present invention will be described later.

Arrows F1, F2, F3, and F4 indicate four paper sheet convey paths. The paper sheet convey path F1 is a path for the paper sheet conveyed on the basis of a saddle stitching command. The convey path F2 is a path for the cover sheet which is conveyed through the convey path F1 and serves as the cover of the sheet bundle stacked on the saddle stitching unit 73. The convey path F3 is a path for conveying, to the tray 79, a paper sheet which need not be saddle-stitched. The paper sheet convey path F4 is a path for a paper sheet which needs to be post-processed by another post-processing apparatus (not shown) which can be integrally coupled to the post-processing apparatus of this embodiment. Many convey roller pairs (without any reference numerals) are arranged on these convey paths.

Reference numeral 700 denotes a switching means which is controlled in accordance with the contents of the operation command issued by a control unit (not shown) to selectively make the convey path F1 or the convey path F3 available (usable). Another switching means 703 is also controlled in the same manner to selectively make the convey path F3 or the convey path F4 available.

The center folding unit 71, saddle stitching unit 73, and cutting unit 76 respectively have stoppers 719, 739, and 762. The stoppers 719, 739, and 762 are automatically and properly set at the respective set positions in accordance with the size of the paper sheet P to be used, e.g., a control signal from a control unit which receives a detection signal from a size detection means mounted on the paper reverse discharging/re-feeding unit 5.

The center folding unit 71 is comprised of a chopper knife 710 formed from a thin plate or knife-like plate member for center-folding (two-folding) the paper sheet P fed to the center folding unit 71 by pushing the substantially middle portion of the paper sheet in a direction (the horizontal leftward direction in this embodiment) perpendicular to the convey direction, a pair of an upper folding roller 713 which has an outer diameter of about 20 to 30 mm, is located upstream in the paper sheet convey direction, and is used to crease the paper sheet P pushed (prodded) by the memory card interface 701 and a lower folding roller 715 which has an outer diameter of about 35 to 40 mm and is located downstream in the paper sheet convey direction, a pinch roller 717 which has an outer diameter of about 20 to 30 mm, can releasably abut against the lower folding roller 715 on the downstream side, and conveys the paper sheet P between itself and the lower folding roller 715, and the stopper 719 which can move in accordance with the size of the paper sheet P, can retract from the convey path for the paper sheet P, and is used to regulate the position of the leading end of the paper sheet P. A folding roller nip point Na is formed between the upper folding roller 713 and the lower folding roller 715. A releasable pinch roller nip point Nb is formed between the lower folding roller 715 and the pinch roller 717 which can releasably abut against the lower folding roller 715.

As is understood from the above description, the pushing member 710, upper folding roller 713, and lower folding roller 715 serve as a center folding means (center folding unit) for creasing a paper sheet in a direction perpendicular to the convey direction.

A center folding process or center folding step is performed on the basis of the following control sequence.

The stopper 719 is placed at a position in the convey path which corresponds to ½ the size of the paper sheet to be used in the convey direction with respect to the nip position between the upper folding roller 713 and the lower folding roller 715 in the height direction. After the leading end of the paper sheet taken in through the inlet 70 reaches the stopper 719, the clockwise rotations of the rollers are stopped.

Subsequently, the paper sheet is pushed between the upper folding roller 713 and the lower folding roller 715 with the pushing member 710 to crease the paper sheet. Thereafter, the above rollers are rotated clockwise again to feed the paper sheet toward the saddle stitching unit 73.

In other words, the overlapped portion of the creased paper sheet, with the crease located on the leftmost side, is conveyed to the right side through the folding roller nip portion Na, while the leading end is conveyed downward.

When the crease is released from the nip portion, the paper sheet is kept conveyed in an open state (without being overlapped).

Before this operation, the stopper 719 and pushing member 710 are retracted from the convey path.

Note that the pair of folding rollers 713 and 715 may be designed to reversely rotate for a short period of time, e.g., several ten ms, in accordance with pushing operation using the pushing member 710. In this case, a one-way clutch may be inserted in the power transmission system for the convey roller 717 to allow the convey roller 717 to idle during the above reverse rotation. Alternatively, the convey roller 717 may be separated from the lower folding roller 715 during this period.

The first convey means 72 is comprised of a rotatable belt 720 which has many holes to convey the paper sheet P from the center folding unit 71 to the saddle stitching unit 73, a suction box 723 serving as a suction member connected to a suction means S to chuck the paper sheet P on the rotatable belt 720, and a peeling member 725 for peeling the trailing end of the paper sheet P from the rotatable belt 720 after the paper sheet P is conveyed to the saddle stitching unit 73.

Reference numeral 725 denotes a rotatable separating member made of a wire rod such as a wire. This member has a function of forcibly separating the paper sheet conveyed while chucked on the lower surface of the rotatable belt 720 owing to the effect of the suction means S by hitting the leading end of the paper sheet from inside (the upper side in FIG. 2) in a region near the left end of the belt.

If, however, the suction force on the lower surface of the rotatable belt 720 gradually decreases toward the left end to allow the paper sheet to be automatically separated before it reaches the left end, the separating member 725 can be omitted.

Note that a fan may be mounted in the suction box 723 to chuck the paper sheet P on the rotatable belt 720. In this case, the paper sheet P can be peeled from the rotatable belt 720 by reversely rotating the fan after it is conveyed to the saddle stitching unit 73.

The paper sheet convey surface of the first convey means 72 is tilted upward toward the downstream side in the paper sheet convey direction in order to facilitate control in stacking paper sheets on an angular stack means (to be described later) and reduce the size of the apparatus.

In order to form an angular stack means for stacking the paper sheets P center-folded (two-folded) by the center folding unit 71 and conveyed through the first convey means 72 one by one, the saddle stitching unit 73 is comprised of a first guide member 730 placed upstream in the paper sheet convey direction, a second guide member 733 having a pushing member for pushing a sheet bundle T to the second convey means 74, a comb-like pushing member 734 formed from a thin plate which is used to align the middle portions of the paper sheets P stacked on the stack means, a press member 740 which is provided to oppose the pushing member 734, an aligning plate 732 for aligning (width-aligning) the sheet bundle (booklet) T stacked on the stack means in the width direction (perpendicular to the feeding direction of the paper sheet P) for each operation, a stapler head 736 for driving staples into the sheet bundle T, a stapler clincher 735 which is placed to oppose the stapler head 736 to receive staples, and the stopper 739 for making the middle portion of the paper sheet P conform to the doglegged distal end of the press member 740 in accordance with the size of the paper sheet P. The pushing member 734, press member 740, and aligning plate 732 serve to align the sheet bundle (booklet) T. The stapler clincher 735 and stapler head 736 serve to staple the sheet bundle T. The second guide member 733 serves to feed the sheet bundle T to the second convey means 74.

The cutting unit 76 is comprised of the stopper 762 for positioning the leading end of the sheet bundle (booklet) T in accordance with the size of the paper sheet P, upper and lower belt rollers 651 and 654 which convey the leading end of the sheet bundle (booklet) T to the position of the stopper 762, a pressure member 765 for pressing the sheet bundle T positioned by the stopper 762, and a rotating cutter 763 serving as a cutting member for the alignment (edge cutting or decorative cutting) of the trailing end of the sheet bundle T pressed by the pressure member 765. The pressure member 765 and rotating cutter 763 serve to perform decorative cutting. The use of the rotating cutter 763 as a cutting member makes it possible to reduce the size of the cutting unit 76. Reference numeral 766 denotes a sensor for detecting the trailing end of the sheet bundle T.

The first and second guide members 730 and 733 are formed from plate members each placed at a predetermined tilt angle, e.g., about 45°, with respect to a vertical plane, and form an angular shape as a whole. There is a gap between the end portions of the two guide members on the top portion side.

The end portions of the two guide members 730 and 733 which are located in a top portion region (a region which is located near the top but does not include the top) are placed to oppose each other through a predetermined gap.

In other words, the angular stack means is comprised of the first guide member 730 which has a predetermined length in the depth direction in FIG. 2 and descends from the upper end portion in the first direction (lower right in FIG. 2) at a predetermined tilt angle and the second guide member 733 which has almost the same length as that of the first guide member 730 in the depth direction and descends from the upper end portion, which is spaced apart from the upper end portion from the first guide member 730 by a predetermined distance, in the second direction (lower left in FIG. 2) at almost the same tilt angle as that of the first guide member 730.

In this case, the angular shape is a shape that is formed by placing the two guide members so as to make their extension lines intersect each other.

The tilts of the two guide members 730 and 733 with respect to a vertical plane may be equal or different and are not limited to those in this embodiment. In consideration of handling, however, it is preferable that these tilt angles be almost equal to each other.

Note that the upper end portion of the second guide member 733 is located higher than the upper end portion of the first guide member 730.

In addition, a middle portion 733-1 (see FIG. 5) split in the longitudinal direction of the second guide member 733 is designed to reciprocally move from the position shown in FIG. 2 to the upper right by a predetermined distance.

With this structure, the distal end of the middle portion 733-1 is moved to the crease of the lowermost paper sheet of the sheet bundle having undergone a saddle stitching process so as to push the sheet bundle between the belts of the second convey means 74 while forming it into the form of a two-folded booklet.

Since part of the second guide member is used to discharge a sheet bundle from the stack means, there is no need to provide any special discharging means. This makes it possible to simplify the mechanism (arrangement) and effectively use a space.

Figure 5:
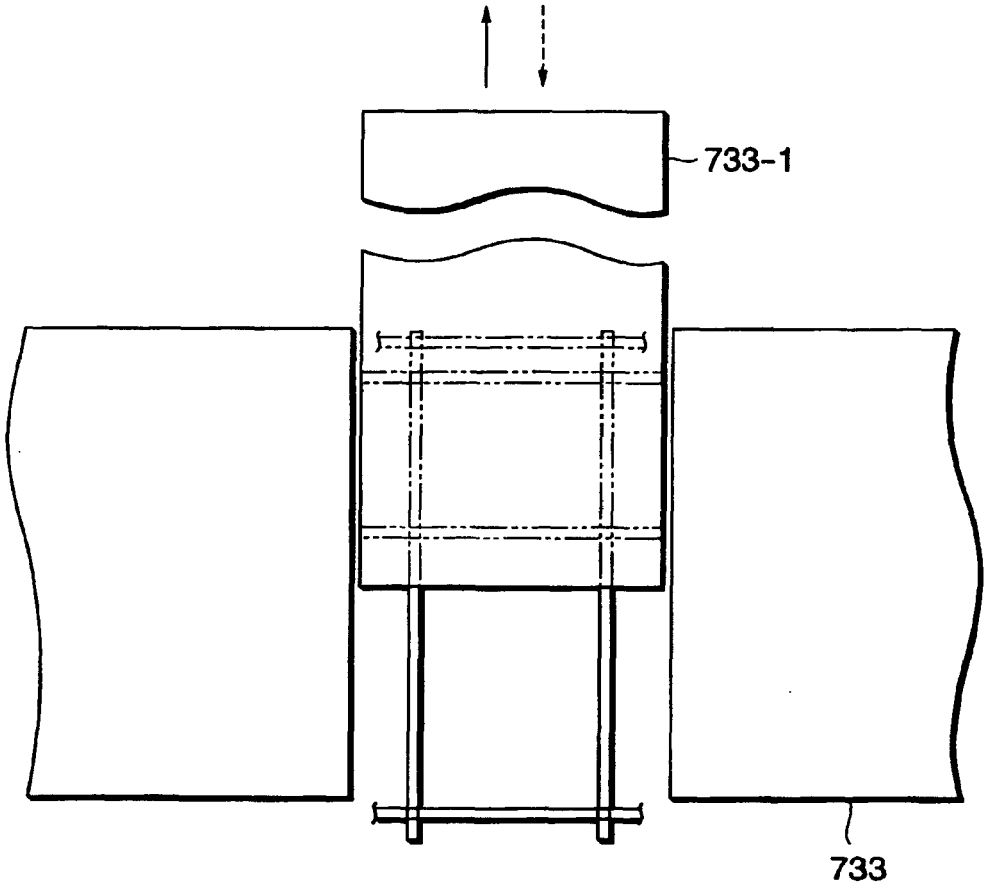
FIG. 5 is a plan view showing the arrangement of a second guide member.

Although FIG. 5 schematically shows the arrangement of the second guide member, a known method can be used for a power system for rotating a threaded support rod, and hence an illustration thereof will be omitted.

The staple receiving means (staple clincher) 735 is placed at the middle position between the first and second guide members 730 and 733 so as to be fixed at a height position and movable in the depth direction (the direction perpendicular to the drawing surface). Part of the upper portion of this means is located in the gap in the top portion region of the two guide members.

The staple driving means (staple head) 736 is placed above the staple receiving means 735 with a predetermined gap ensured therebetween. The staple driving means 736 can swing on a shaft 737 and move in the depth direction.

In this embodiment, as described above, the upper end portion of the first guide member 730 is located lower than that of the second guide member 733 in consideration of physical factors such as the shape and size of the staple receiving means 735 and the intention of reducing the apparatus size. Obviously, however, the first guide member 730 and second guide member 733 can be arranged symmetrically if there is no need to arrange them asymmetrically.

The stapler constituted by the staple driving means 736 and staple receiving means 735 has an ability to bind 100 paper sheets. Two such staplers are prepared so as to be spaced apart from each other by a proper distance in the depth direction in FIG. 2.

In this embodiment, a booklet of 50 paper sheets folded in two can be obtained.

Figure 6:
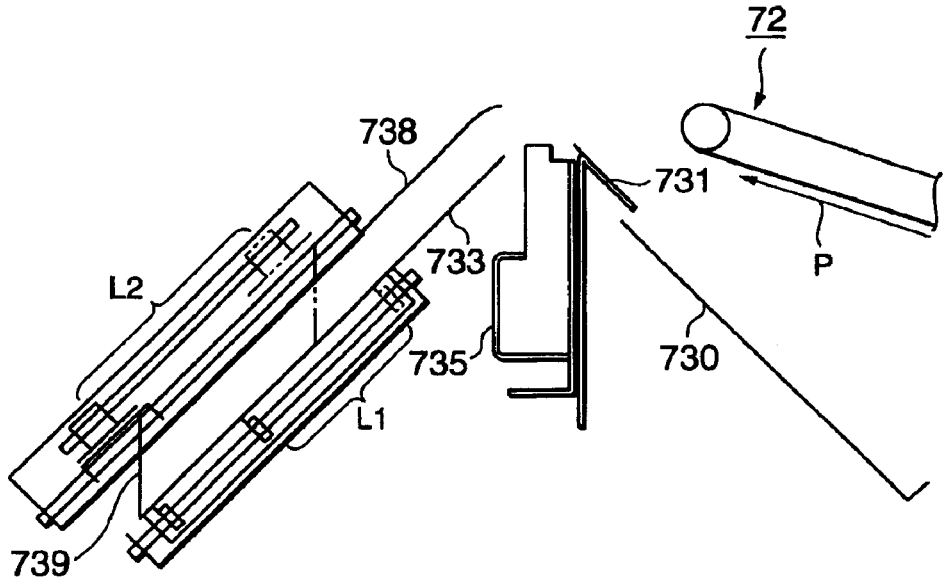
FIG. 6 is an enlarged schematic view showing the relationship between guide members and a staple receiving means in a saddle stitching unit.

FIG. 6 is an enlarged view showing the relationship between the above two guide members 730 and 733 and the staple receiving means 735 in the saddle stitching unit 73.

Referring to FIG. 6, reference numeral 731 denotes an auxiliary guide member having a function of preventing the leading end of the conveyed paper sheet P from entering the gap formed between the upper end portion of the first guide member 730 and the upper portion of the staple receiving means 735 or preventing the upper portion of a placed paper sheet which is located on the first guide member 730 side from being damaged by the shape of the staple receiving means 735. A flexible film sheet (with no reference numeral) is bonded on the guide surface of the auxiliary guide member 731 so as to protrude from its upper portion.

In addition, the height position of the protruding distal end (free end) of the film sheet is higher than that of the second guide member so as not to interfere with the conveyance of a paper sheet.

Reference symbol L1 written in association with the second guide member 733 denotes the movable range of the middle portion 733-1 described above.

Reference numeral 738 denotes a regulating member which has an arcuated region at a top portion on the entrance side of paper sheets and is placed parallel to the second guide member 733 so as to be spaced apart therefrom. This member regulates the movement of the paper sheet fed to the saddle stitching unit 73 to make the paper sheet easily fall on the first and second guide members 730 and 733 constituting the stack portion. The stopper 739 is integrally provided with the regulating member. Reference symbol L2 denotes the movable range of the stopper 739.

In other words, when the size of a paper sheet to be used is detected by a proper means, the above stopper is moved to a predetermined position, e.g., a position at a distance slightly longer than the distance from the leading end of the paper sheet to the crease in the convey direction, and is fixed at the position.

This arrangement can facilitate alignment with reference to the crease of a paper sheet. More specifically, when the leading end of a conveyed paper sheet comes into contact with the stopper 739, the paper sheet is bent into an angular shape along the first and second guide members 730 and 733 to produce bending stress.

When, for example, the paper sheet is released from conveyance by the first convey means 72, the paper sheet is pushed back toward the first guide member 730 due to the reaction of the accumulated bending stress and at the same time falls on the first and second guide members 730 and 733. Owing to the effect of the crease, the position of the crease can be easily aligned with a predetermined position on the stack means, i.e., a position corresponding to the top (the central position of the angular shape in FIG. 6).

Alternatively, the crease of the succeeding paper sheet can be easily overlaid on the crease of the paper sheet that has already been stacked, thereby performing alignment.

As described above, this simple arrangement makes it possible to align and stack paper sheets.

Control associated with the first convey means 72 and the like can be easily implemented by a computer (not shown) for controlling an image sequence or another or control means formed from another computer (not shown) that can communicate with the above computer.

Processing in the sheet post-processing apparatus B having the above arrangement will be described below.

The paper sheet P fed into the center folding unit 71 through the inlet 70 of the sheet post-processing apparatus B is center-folded by the center folding unit 71 to be creased. As indicated by the arrow in FIG. 2, the paper sheet is conveyed to the first convey means 72 along the convey direction perpendicular to the crease by the upper folding roller 713 and the lower folding roller 715 in contact with the lower folding roller 715, which rotate clockwise.

The paper sheet P conveyed to the first convey means 72 is chucked by the rotatable belt 720 and conveyed to the saddle stitching unit 73 having the doglegged path.

The leading end of the paper sheet P abuts against the stopper 739 of the saddle stitching unit 73 which moves by the distance corresponding to the sheet size. At this time, the trailing end of the paper sheet P chucked to the rotatable belt 720 is hit by the peeling member 725 of the first convey means 72 to fall. As a result, the paper sheet P is peeled from the rotatable belt 720. In addition, the paper sheet P is conveyed until the crease on the middle portion of the sheet is stopped by the doglegged portion of the press member 740. The paper sheet P abuts against the stopper 739 and stopped with the crease facing up on the doglegged stack portion.

The pushing member 734 is moved up and down to push the crease on substantially the middle portion of the paper sheet P toward the press member 740. At the same time, the press member 740 is rotated about the shaft 737 (the distal end portion is lowered) to hit the crease of the paper sheet P with the press member 740. Thereafter, the press member 740 is raised. At the same time, width-alignment (alignment in the width direction) is performed by the aligning plate 732.

The above operation is repeated for each paper sheet P to form a properly aligned sheet bundle (booklet) T which is a bundle of a predetermined number of paper sheets, e.g., five paper sheets, on the doglegged portion of the saddle stitching unit 73. Thereafter, a cover sheet is reversed/conveyed from the cover sheet feeder 78 to the center folding unit 71, as needed, with the character-printed surface facing up. After the cover sheet is center-folded and creased by the center folding unit 71 in the same process as described above, the cover sheet is conveyed to the saddle stitching unit 73 through the first convey means 72 and stacked on the uppermost surface of the sheet bundle T.

While the sheet bundle (booklet) T is held by the press member 740 and pushing member 734, staples are driven into the sheet bundle from above by the stapler head 736 which is rotated about the shaft 737. The distal ends of the staples are bent from below by the fixed stapler clincher 735. In this operation, the staples are driven into the sheet bundle T, on which the cover sheet is stacked, at, for example, two positions, thereby staple-binding the sheet bundle T.

The staple-bound sheet bundle (booklet) T is pushed toward the second convey means 74 by the middle portion 733-1 of the second guide member 733. The sheet bundle T conveyed to the second convey means 74 by the belt member (with no reference numeral) is conveyed to the cutting unit (trimmer unit) 76 through the third convey means 75.

When the leading end of the sheet bundle (booklet) T conveyed to the cutting unit 76 abuts against the stopper 762, the sheet bundle stops while it is clamped between upper and lower belt rollers 761 and 764. At the same time, the swelling of the sheet bundle T is eliminated by the pressing force of the pressure member 765. Subsequently, the trailing end portion of the sheet bundle (booklet) T is cut by the rotating cutter 763 for aesthetic reason such that the read end faces after cutting align with each other.

After the trailing end portion of the sheet bundle (booklet) T is cut by the trimmer unit 76 for aesthetic reason, the stopper 762 and pressure member 765 are released from the sheet bundle T to feed the sheet bundle T to the booklet stack unit 77. The sheet bundle (booklet) T is then stacked on the booklet stack unit 77. The booklet stack unit 77 is lowered step by step every time the sheet bundle (booklet) T is stacked.

A center-folding process in the center folding unit 71 provided in the sheet post-processing apparatus B and set conditions for the respective members will be described next with reference to FIGS. 3 and 4.

Figure 3:
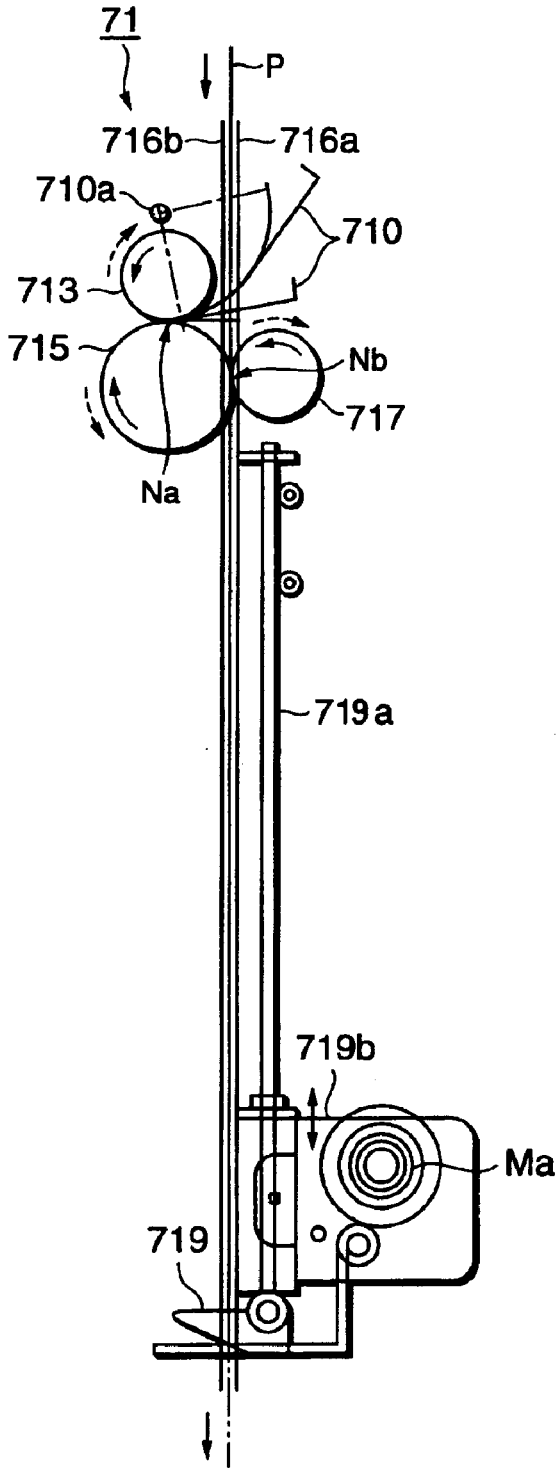
FIG. 3 is a longitudinal sectional view showing a center folding unit.

The paper sheet P fed through the inlet 70 is conveyed in the paper sheet convey direction indicated by the solid arrow in FIG. 3 to the center folding unit 71 including the pair of folding rollers rotating forward, i.e., the upper folding roller 713 (which rotates counter when it rotates forward) and the lower folding roller 715 (which rotates clockwise when it rotates forward), and the pinch roller 717 rotating forward (which rotates counterclockwise when it rotates forward). When the paper sheet P is fed to the center folding unit 71, the pinch roller 717 is in contact with the lower folding roller 715, and the pinch roller nip point Nb is formed between the pinch roller 717 and the lower folding roller 715. The paper sheet P is nipped (clamped) at the pinch roller nip point Nb and conveyed between a paper guide plate 716*a* and a paper guide plate 716*b*. Immediately before the paper sheet P comes into contact with the stopper 719, the contact between the pinch roller 717 and the lower folding roller 715 is temporarily released (at the position indicated by the chain line in FIG. 4) to let the paper sheet P abut against the stopper 719 by a free fall, thereby aligning the paper sheet. This makes it possible to prevent any ramp of the paper sheet P. At this time, the paper sheet P is stopped while its portion located slightly upstream from the position of the folding roller nip point Na formed between the upper folding roller 713 and the lower folding roller 715 is regarded as a substantially middle portion.

The stopper 719 is moved in accordance with the size of a paper sheet to be used by sliding (vertically moving in this embodiment as shown in FIG. 3) a slide frame 719*b*, on which the stopper 719 is mounted, along a guide rod 719*a* serving as a guide by rotating/driving a stopper driving motor Ma through a pulley, wire, and the like (not shown). For example, the stopper 719 can rotate about a rotating shaft (not shown) and retract from the paper guide plates 716*a* and 716*b*.

When the paper sheet P is stopped by the stopper 719 at a position slightly upstream from the folding roller nip point Na, the pinch roller 717 is brought into contact with the lower folding roller 715 again to nip and fix the paper sheet P at the pinch roller nip point Nb. The chopper knife 710 is then rotated about a chopper rotation fulcrum 710 toward the paper sheet side (toward the position indicated by the chain line in FIG. 4) to fold the middle portion of the paper sheet P with the chopper knife 710 up to a position immediately before the folding roller nip point Na. That is, the chopper knife 710 has a fulcrum which is located on the folding roller side in the paper sheet convey direction and on the upstream side of the lower folding roller 715 on the upstream side, and pushes the paper sheet P to the folding roller nip point Na between the upper folding roller 713 and the lower folding roller 715 while pivoting.

After the middle portion of the paper sheet P is folded by the chopper knife 710, the chopper knife 710 is retracted (to the position indicated by the solid line in FIG. 4), and the upper folding roller 713, lower folding roller 715, and pinch roller 717 are rotated reversely (the upper folding roller 713 is rotated in the clockwise direction indicated by the dotted line, the lower folding roller 715 is rotated in the counter-clockwise direction indicated by the dotted line, and the pinch roller 717 is rotated in the clockwise direction indicted by the dotted line) to feed the middle portion of the paper sheet P from the folding roller nip point Na to the opposite side to the paper guide plate 716*b* by about 5 to 10 mm, thereby creasing the middle portion of the paper sheet P.

After the middle portion of the paper sheet P is creased, the stopper 719 is released, and the upper folding roller 713, lower folding roller 715, and pinch roller 717 are rotated forward again to discharge the center-folded paper sheet P from the center folding unit 71 by the rotations of the lower folding roller 715 and the pinch roller 717 which is in contact with the lower folding roller 715.

The above center-folding processing is repeated for each paper sheet P. A cover sheet is fed to the center folding unit 71 to be center-folded as needed, and the center-folded cover sheet is discharged from the center folding unit 71.

Figure 4:
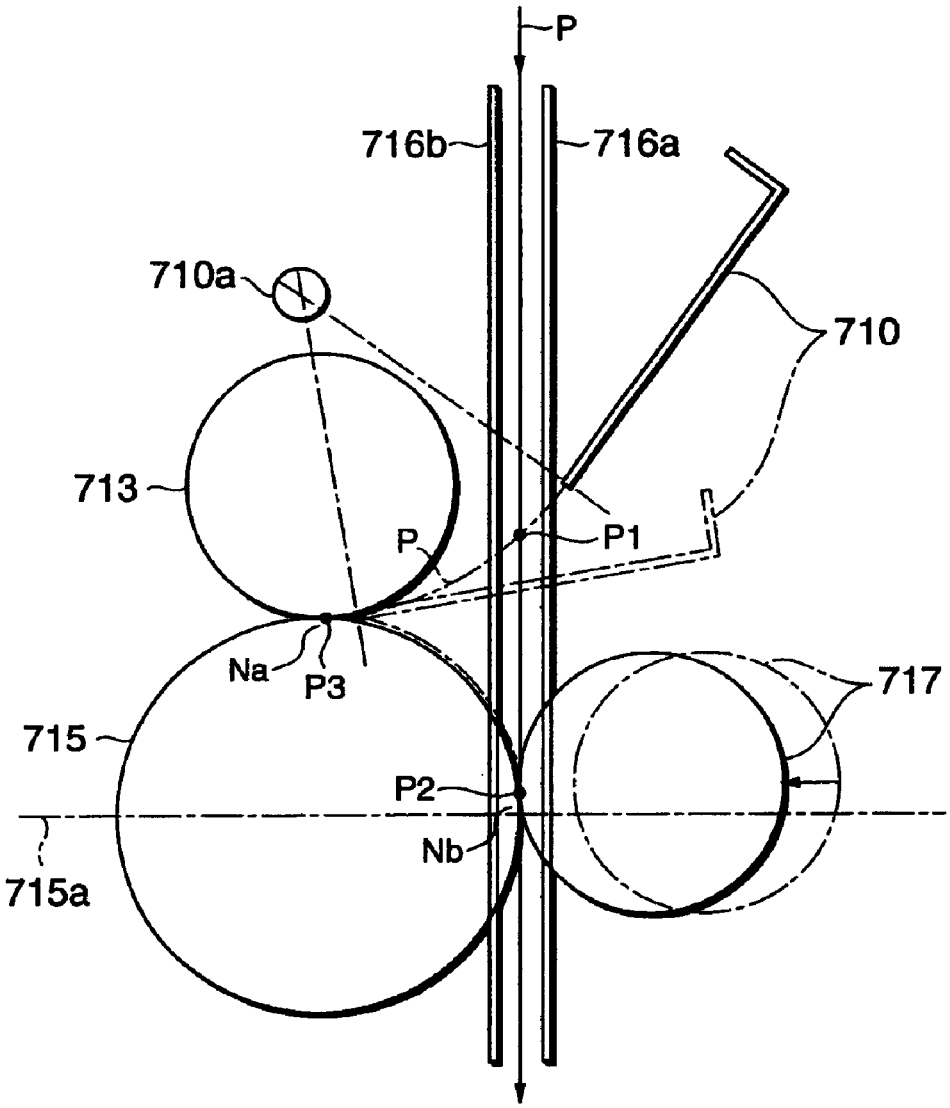
FIG. 4 is an enlarged sectional view of the main part in FIG. 3.

As shown in FIG. 4, it is preferable that the distance from a position P1 where the chopper knife 710 comes into contact with the paper sheet P to the pinch roller nip point Nb (a point P2) where the paper sheet P is fixed be almost equal to the peripheral length from the folding roller nip point Na (point P3) on the lower folding roller 715 in the paper sheet convey direction to the pinch roller nip point Nb (point P2). With this arrangement, the middle portion of the paper sheet P can be pushed to the folding roller nip point Na by making the distal end of the chopper knife 710 push the same portion of the paper sheet P. This makes it possible to properly fold the middle portion of the paper sheet P without applying any stress to the paper sheet P.

It is also preferable that the position where the pinch roller 717 comes into contact with the lower folding roller 715 on the downstream side in the paper sheet convey direction to form the pinch roller nip point Nb be set slightly (about 0 to 5 mm) upstream from the central position of the lower folding roller 715 on the downstream side with which the pinch roller 717 comes into contact. Positioning the pinch roller 717 in this manner allows the folded paper sheet P to enter inside (to the folding roller nip point Na side).

Note that the lengths of the first and second guide members 730 and 733 or the positions of the lower end portions of the guide members are sufficient lengths with respect to the length from an end portion of the paper sheet P with the maximum size to be used to the position where it is center-folded (e.g., ½ the length of the paper sheet) or sufficiently lower than an end portion of a stacked paper sheet.

The merits of this arrangement will be described with reference to FIGS. 7A and 7B which are views for explaining how a trouble occurs in stacking a paper sheet and automatic restoration from the trouble is performed.

Figure 7A:
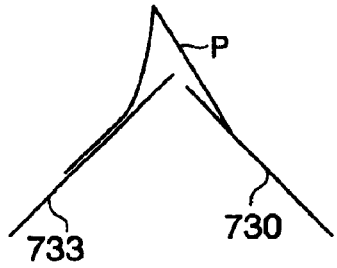
FIGS. 7A and 7B are views for explaining how a trouble occurs in stacking paper sheets and automatic restoration from the trouble.
Figure 7B:
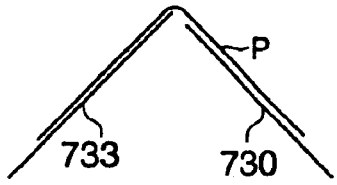

Assume that as shown in FIG. 7A which is a schematic view, the paper sheet P falls on the stack means while the crease is offset from the middle portion of the stack means, i.e., the virtual roof portion (middle portion) of the stack means. Even in this case, the paper sheet is braked by the friction between itself and the surface of the second guide member 733, and is restored to the proper posture as shown in FIG. 7B due to the elasticity produced in the paper sheet at this time. This facilitates alignment of the paper sheet with respect to the stack means.

Even if a paper sheet has already been stacked on the stack means, the above restoration phenomenon based on the elasticity of a paper sheet occurs in the succeeding paper sheet in the same manner.

If a conveyed paper sheet is continuously conveyed by the first convey means 72, even slightly, after the leading end of the conveyed paper sheet abuts against the stopper 739, the paper sheet is bend to produce bending stress.

When the paper sheet is released from conveyance by the first convey means 72, the reaction of the accumulated bending stress causes the paper sheet to mount on the first and second guide members constituting the stack means while being pushed back toward the first guide member 730. As a consequence, the crease position coincides with the top position of the angular stack means.

In addition, in order to further ensure alignment of the crease of a paper sheet at the top position of the stack means, i.e., the formation of an overlaid state, the following arrangement is provided on each side of the stapler in the sheet post-processing apparatus B of the present invention.

Figure 8:
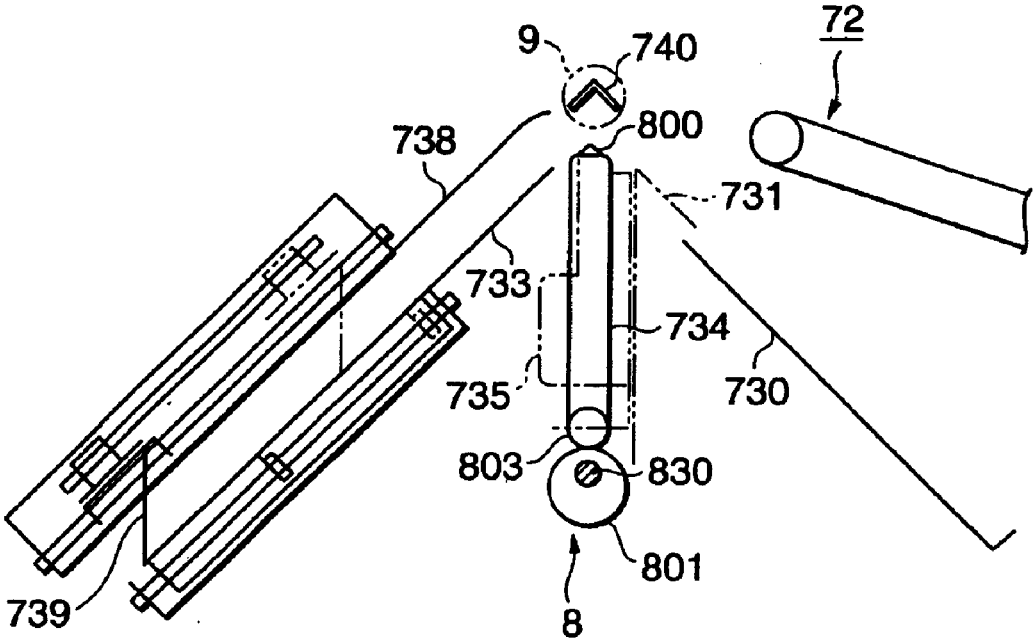
FIG. 8 is a schematic view for explaining an aligning means (aligning mechanism)

FIG. 8 is a schematic view for explaining the arrangement, function, and the like of an alignment means (alignment mechanism). Referring to FIG. 8, reference numeral 8 denotes an alignment means; 734, the pushing member having a head portion 800 in the form of a wedge (roof); and 801, an eccentric cam fixed on a rotating shaft 830.

The eccentric cam 801 causes the pushing member 734 to move up and down through a cam follower 803 provided on the lower end of the pushing member 734.

The pushing member 734 moves upward to push the paper sheet stacked on the first and second guide members 730 and 733 upward through the middle portion of the paper sheet (the crease of the paper sheet stacked on the guide members in a contact state). Thereafter, the pushing member 734 moves downward. At this time, the press member 740 is controlled to move downward together with the pushing member 734 while pressing the paper sheet and then return to the initial position.

In other words, although the crease of the paper sheet that is pushed up is easily aligned with the top of the head portion owing to the wedge effect of the pushing member 734, the paper sheet may float as the pushing member 734 moves downward to result in making the alignment useless.

In order to suppress occurrence of such a trouble, the press member 740 is designed to move downward in cooperation with the pushing member 734 while pressing a paper sheet. This makes it possible to maintain a good aligned state.

Alignment of a paper sheet through the pushing member 734 is nothing but an effect easily obtained because the conveyed paper sheet has already been creased.

The pushing member 734 and press member 740 constituting the alignment means 8 are preferably actuated every time a paper sheet is fed. These two members can be controlled by a control means as members for pressing paper sheets in staple driving operation (saddle stitching process). The moving stroke and speed of the pushing member 734 can be properly determined by experiment.

Figure 9:
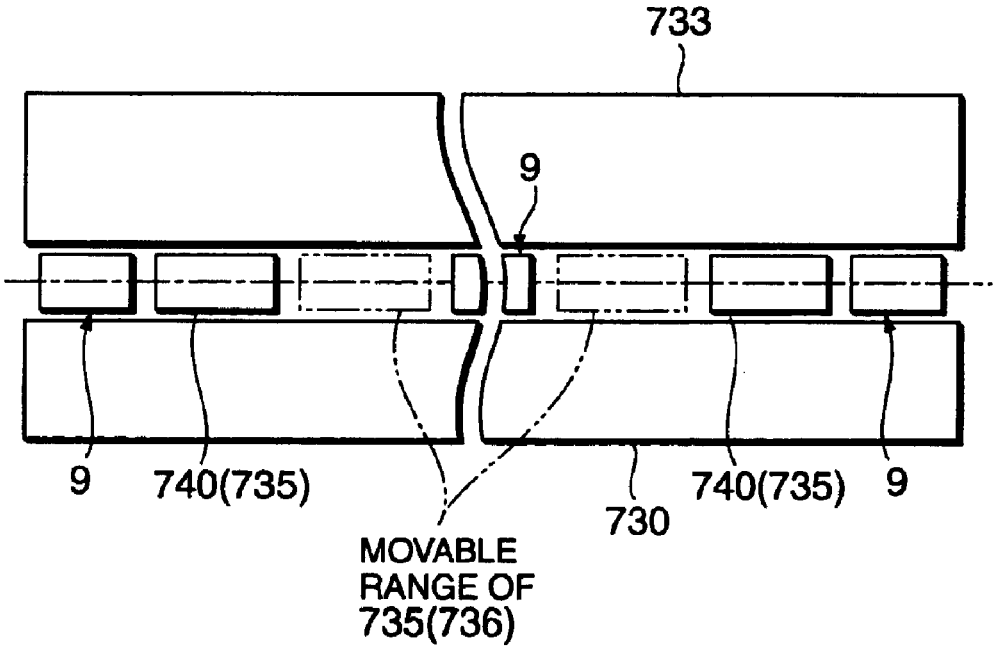
FIG. 9 is a plan view showing the positional relationship between a pushing member, a press member, a staple driving means, and a staple receiving means in the saddle stitching unit.

As shown in the schematic plan view of the FIG. 9, the pushing member 734 and press member 740 constituting the alignment means 8 can be arranged at proper positions in the depth direction, other than positions in the movable range of the stapler constituted by the staple receiving means 735 and arm member 376, so as to oppose each other. The width and number of such alignment means can be properly determined.

Referring to FIG. 8, reference numeral 9 denotes a convey assistance means which is fixed at a position and has a function of guiding the leading end of a paper sheet, which is separated from the first convey means 72 and moves in a flying state, between the regulating member 738 and the second guide member 733.

Figure 10A:
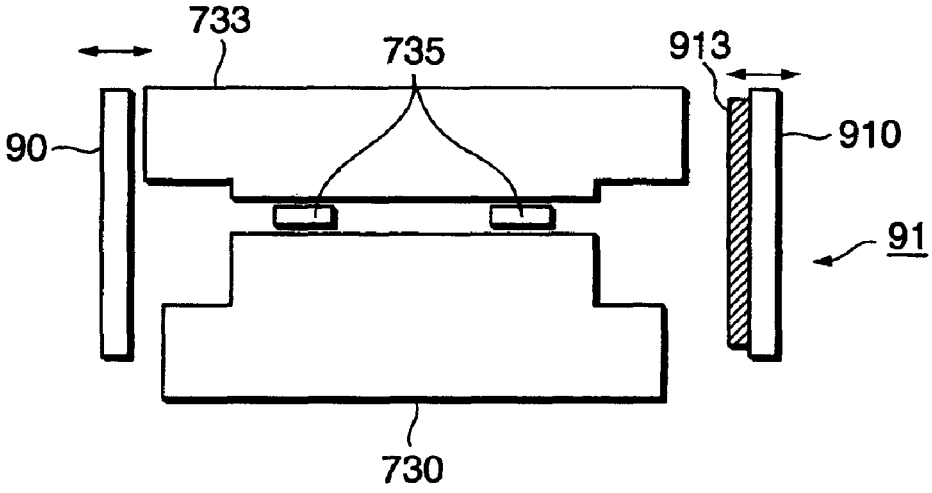
FIGS. 10A and 10B are plan and perspective views for explaining the arrangement of regulating members for aligning paper sheets in the width direction.
Figure 10B:
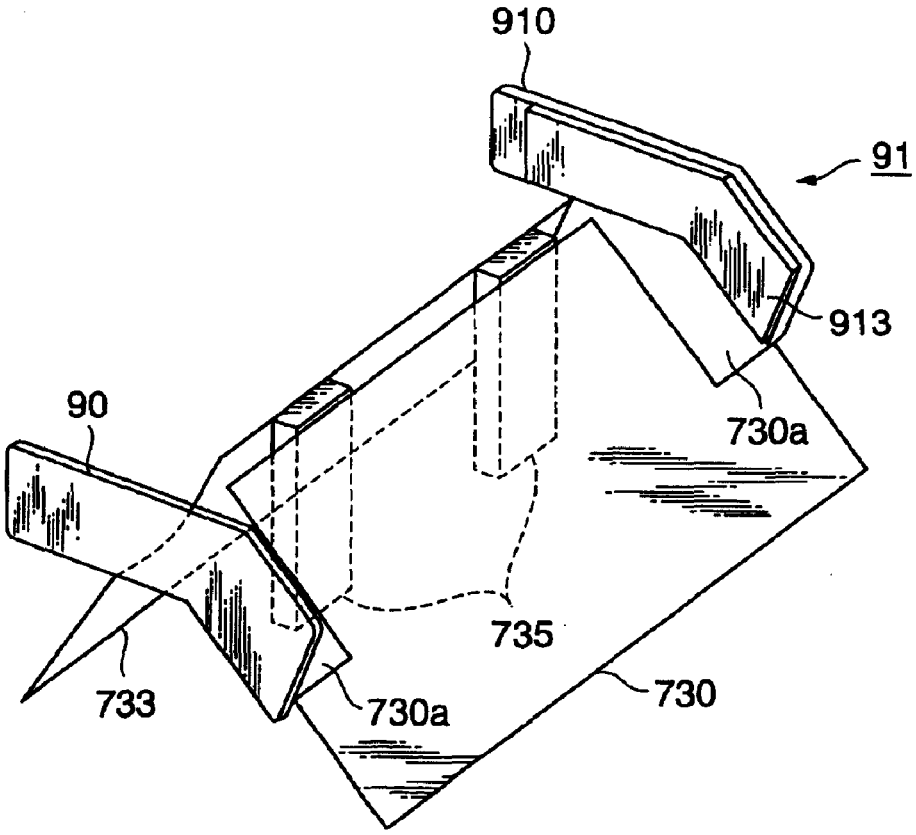

FIGS. 10A and 10B are schematic views for explaining the arrangement of a regulating member (to be referred to as a width regulating member hereinafter for the sake of descriptive convenience) for alignment in the width direction of a paper sheet. FIG. 10A is a plan view of this member. FIG. 10B is a perspective of the member.

Referring to FIGS. 10A and 10B, reference numerals 90 and 91 denote first and second width regulating members provided on the two sides of the first and second guide members 730 and 733 in the width direction. The movement of the two members is controlled to ensure an interval slightly larger than the width of a paper sheet to be used, as indicated by the arrows. Each member can come into light contact with a side of a conveyed paper sheet.

In this case, in order to prevent damage to the paper sheet due to contact with a side of the paper sheet, the second width regulating member 91 is constituted by a restring portion 913 formed from an elastic thin plate (leaf spring) and a holding plate (a fixed portion with respect to the regulating portion) 910 for holding the regulating portion.

It suffices if the restring portion 913 has weak elasticity to allow it to escape outward upon contact with a side of a conveyed paper sheet and press the paper sheet against the first width regulating member 90 with accumulated spring force so as to align it at the time of restoration.

The first and second width regulating members 90 and 91 are set at height positions where they come into contact with the crease of a paper sheet stacked on the first and second guide members 730 and 733 or a portion near a crease region including or not including the crease.

Such height positions are set because a better effect can be obtained and damage to a paper sheet can be minimized by making the regulating members come into contact with a side portion of the paper sheet which is increased in rigidity by the crease rather than making the regulating members come into contact with a side portion of the paper sheet which has low elasticity.

In this case, the height position where each regulating member comes into contact with a portion near the crease of a paper sheet is based on the assumption that this portion has a predetermined width in the height direction. This position should not limited by any specific numerical value. For example, however, a height position may be set such that each regulating member comes into contact with a side portion of a paper sheet which falls within the range of about 5 or 6 cm from the crease of the paper sheet. This makes it possible to properly regulate a paper sheet regardless of whether, for example, it has a wide or narrow angular shape or is thick or thin.

As shown in FIG. 10B, upper portions of the first and second guide members 730 and 733 in this embodiment which are located on the front and rear sides are notched, and first and second width regulating members 90 and 91 are positioned in notched portions 730*a* and 730*b*.

Each of the first and second width regulating members 90 and 91 has a portion extending along the inclined surface of the first guide member 730 and a portion continuously extending therefrom in the horizontal direction. The restring portion 913 has a shape conforming to this shape. However, the restring portion 913 may have a rectangular shape extending in the horizontal direction as a whole.

Note that in place of the restring portion 913, the holding plate 910 may be elastically mounted with a spring member to serve as the second regulating member. Alternatively, a plate member replacing the leaf spring may be elastically formed from a spring member.

In consideration of handling, the convey assistance means 9 is preferably formed from a roller, e.g., a sponge roller. Alternatively, a paddle is preferably used. Rotation of such a member is preferably controlled at least during the period in which a paper sheet passes through.

Referring to FIG. 2, after paper sheets or the like are aligned in the width direction by the alignment means constituted by the first and second width regulating members 90 and 91, a sheet bundle is subjected to a saddle stitching process in the arrangement described above. This sheet bundle is pushed to the upper right by the upper end portion of the middle portion 733-1 of the second guide member 733 and is transferred to the second convey means 74 while being gradually formed into a booklet. The sheet bundle is then pressed/conveyed between belt rollers 741 and 742 to be firmly creased at the position of a crease c and discharged. The sheet bundle is further received between a roller 751 and a belt rollers 752 in tight contact with the roller 751 to be conveyed as the sheet bundle T while its convey direction is changed. The sheet bundle is then fed through a belt roller 753, interlocked with the belt rollers 752, and a nip roller 755. In this manner, the sheet bundle is firmly folded in two owing to the effect of the third convey means 75. Thereafter, the sheet bundle is conveyed between the lower belt roller 761 and the stopper 762 provided next to the third convey means, and is stopped at a predetermined position by the stopper 762. At the same time, the sheet bundle is pressed by the press plate 765, and the edge of the sheet bundle is cut by a rotary cutter 766 moving in a direction perpendicular to the convey direction of the sheet bundle T. After this cutting process, the press plate 765 moves upward, and the two belt rollers pivot in the direction indicated by the arrow to discharge the sheet bundle onto the stack unit 77.

The stack unit 77 sequentially descends in accordance with the quantity of sheet bundles stacked to allow a predetermined quantity of sheet bundles to be stacked.

Assume that the above sheet bundle is to be covered with a cover. In this case, after image-bearing paper sheets are stacked on the stack means of the saddle stitching unit 73, the cover sheet feeder 78 is actuated to feed one cover sheet. When a proper detection means detects that the cover is placed on the sheet bundle, a binding process is performed.

In this case, the cover sheet is fed downward by a paper feed means 100, and the leading end is delivered on the convey path F4. The end portion of the cover sheet which is the trailing end in the convey direction then reaches the center folding unit 71 as a leading end. The cover sheet is subjected to the same center folding process as that for paper sheets. The cover sheet is placed on the stacked paper sheets and integrated therewith by staple driving operation like that described above.

Figure 11A:
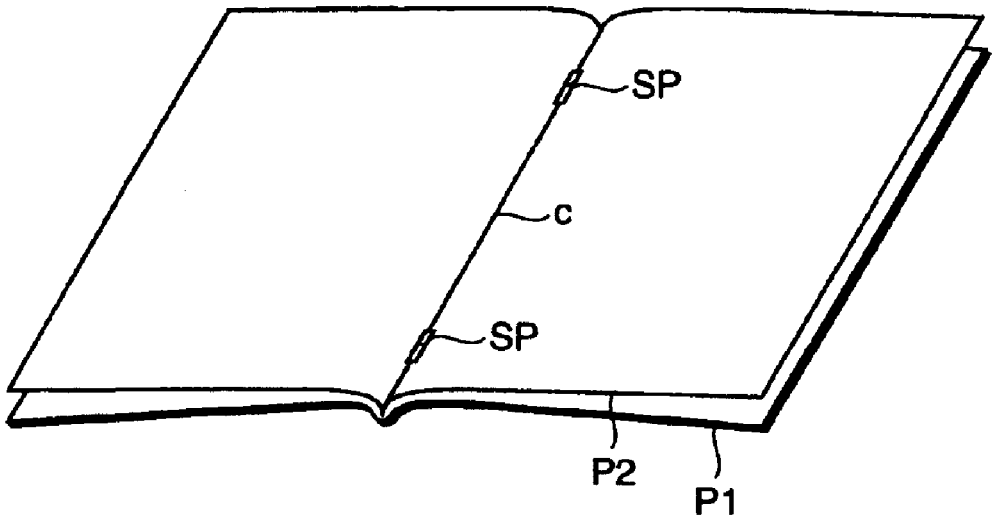
FIGS. 11A and 11B are a perspective view of saddle-stitched paper sheets and a sectional view of two-folded paper sheets.
Figure 11B:
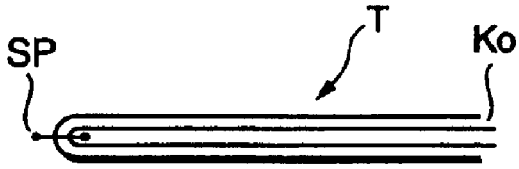

FIGS. 11A and 11B are views respectively showing the states of paper sheets and a booklet which have undergone a saddle stitching process and two-folding process. FIG. 11A is a perspective view showing the open state of a sheet bundle obtained by two-folding paper sheets P1 and P2 and saddle-stitching the sheets by driving metal staples SP into them at the position of a crease c using the stapler. FIG. 1B is a sectional view of the booklet T formed by center-folding the paper sheets. Reference symbol Ko denotes the edges of the booklet T.

What is claimed is:

1. An image forming apparatus integrally having a sheet post-processing apparatus comprising:

center folding means for creasing, on a convey path for conveying image-bearing paper sheets and/or cover sheets one by one in a predetermined direction, each of the paper sheets and/or cover sheets in a direction perpendicular to the convey direction of the paper sheets, said center folding means being comprised of a pair of folding rollers which are arranged along the convey direction of each of the paper sheets and form a folding roller nip point where the paper sheet is creased with pressing forces of said pair of folding rollers, a chopper knife which pushes the paper sheet to the folding roller nip point, a pinch roller which is placed to detachably come into contact with one of said pair of folding rollers which is located downstream in the convey direction of the paper sheet, and a stopper against which the leading end of the paper sheet conveyed along the convey path abuts, and when the leading end of the paper sheet abuts against said stopper, the paper sheet is clamped at the pinch roller nip point formed between said folding roller located down-stream and said pinch roller, and said chopper knife is actuated to push the paper sheet to the folding roller nip point while the paper sheet is clamped, thereby creasing the paper sheet;

stack means which has an angular shape and on which each of the paper sheets and/or cover sheets is stacked;

first convey means for conveying each of the paper sheets and/or cover sheets, in an open state, on which a crease has been produced by said center folding means, and sticking a predetermined number of paper sheets and/or covet sheets on said stack means for every operation;

convey assistance means provided near a top portion said stack means;

saddle stitching means for forming a predetermined number of paper sheets and/or cover sheets stacked on said stack means into a booklet (sheet bundle) by binding the paper sheets end/or cover sheets at the crease;

second convey means for conveying the saddle-stitched booklet in a two-folded state;

cutting means for performing a cutting process so as to align edges of the two-folded booklet; and discharging means for discharging the two-folded booklet outside said apparatus after the cutting process.

2. An apparatus according to claim 1, wherein said chopper knife has a fulcrum located on a folding roller side in the convey direction of the paper sheet and positioned upstream from said upstream folding roller, and is actuated to push the paper sheet to the folding roller nip point while pivoting.

3. An apparatus according to claim 1, wherein a distance from a position where said chopper knife comes into contact with the paper sheet to the pinch roller nip on which the paper sheet is fixed is substantially equal to a peripheral length of said downstream folding roller from said folding roller to the pinch roller nip.

4. An apparatus according to claim 3, wherein a set position of said pinch roller is slightly upstream from a central position of said downstream folding roller in contact with said pinch roller.

5. An image forming apparatus integrally having a sheet post-processing apparatus comprising:

center folding means for creasing, on a convey path for conveying image-bearing paper sheets and/or cover sheets one by one in a predetermined direction, each of the paper sheets and/or cover sheets in a direction perpendicular to the convoy direction of the paper sheets;

stack means which has an angular shape and on which each paper sheet and/or cover sheet is stacked;

first convey means for conveying each of the paper sheets and/or cover sheets, in an open state, on which a crease has been produced by said center folding means, end stacking a predetermined number of paper sheets and/or cover sheets on said stack means for every operation, said first convey means being comprised of an air suction portion which is located near an upstream side of said stack means and includes air suction means, and a rotatable convey belt placed outside said air suction portion, and a paper sheet convey surface of said convey belt is an inclined surface gradually ascending toward said stack means;

convey assistance means provided near a top portion said stack means;

saddle stitching means for forming a predetermined number of paper sheets and/or cover sheets stacked on said stack means into a booklet (sheet bundle) by binding the paper sheets and/or cover sheets at the crease;

second convey means for conveying the saddle-stitched booklet in a two-folded state;

cutting means for performing a cutting process so as to align edges of the two-folded booklet; and discharging means for discharging the two-folded booklet outside said apparatus after the cutting process.

6. An apparatus according to claim 5, wherein said first convey means separates the paper sheet from said convey belt by reversely rotating a fan serving as air suction means.

7. An apparatus according to claim 5, wherein said convey means includes a pivotal separating member which separates the paper sheet from said convey belt.

8. An apparatus according to claim 7, wherein said separating member comprises a wire rod which can be retracted from a region where said convey belt is stretched, and an electric motor which is connected to a proximal end of the wire rod so as to pivot the wire member.

9. An image forming apparatus integrally having a sheet post-processing apparatus comprising:

center folding means for creasing, on a convey path for conveying image-bearing paper sheets and/or cover sheets one by one in a predetermined direction, each of the paper sheets and/or cover sheets in a direction perpendicular to the convey direction of the paper sheets;

stack means which has an angular shape and on which each paper sheet and/or cover sheet is stacked;

first convey means for conveying each of the paper sheets and/or cover sheets, in an open state, on which a crease has been produced by said center folding means, and stacking a predetermined number of paper sheets and/or cover sheets on said stack means for every operation;

convey assistance means provided near a top portion said stack means;

saddle stitching means for forming a predetermined number of paper sheets and/or cover sheets stacked on said stack means into a booklet (sheet bundle) by binding the paper sheets and/or cover sheets at the crease;

second convey means for conveying the saddle-stitched booklet in a two-folded state;

cutting means for performing a cutting process so as to align edges of the two-folded booklet;

discharging means for discharging the two-folded booklet outside said apparatus after the cutting process; and third convey means which is provided between said second convey means and said cutting means and is constituted by a roller and a belt roller so as to change a convey direction of the conveyed booklet.

* * * * *